United States Patent [19]

Iwata et al.

[11] 4,145,871

[45] Mar. 27, 1979

[54] FALSE TWISTING APPARATUS

[75] Inventors: Kōtei Iwata, Gotenba; Yoshiaki Tada, Mishima, both of Japan

[73] Assignee: Toshiba Kikai Kabushiki Kaisha, Tokyo, Japan

[21] Appl. No.: 870,514

[22] Filed: Jan. 18, 1978

[30] Foreign Application Priority Data

Jan. 21, 1977 [JP] Japan ..... 52-6095

[51] Int. Cl.[2] ..... D02G 1/08; D01H 7/92; D02G 1/04

[52] U.S. Cl. ..... 57/340; 57/339

[58] Field of Search ..... 57/77.4, 77.45

[56] References Cited

U.S. PATENT DOCUMENTS

| | | | |
|---|---|---|---|
| 3,373,554 | 3/1968 | Raschle | 57/77.4 |
| 3,394,540 | 7/1968 | Bentov | 57/77.4 X |
| 3,488,941 | 1/1970 | Asaka | 57/77.4 X |
| 3,495,391 | 2/1970 | Njo | 57/77.42 |
| 3,845,613 | 11/1974 | Knebel | 57/77.4 |
| 4,012,897 | 3/1977 | Ogura et al. | 57/77.42 X |
| 4,033,105 | 7/1977 | McNeight et al. | 57/77.4 |

FOREIGN PATENT DOCUMENTS

| | | | |
|---|---|---|---|
| 931065 | 7/1963 | United Kingdom | 57/77.4 |

*Primary Examiner*—Donald Watkins
*Attorney, Agent, or Firm*—Koda and Androlia

[57] ABSTRACT

False twisting apparatus including opposing rotary discs between which a yarn is clamped is provided with a device for supporting the rotary discs to be movable in the axial direction toward and away from each other and is also provided with a member for urging the rotary discs to form a small gap therebetween.

6 Claims, 11 Drawing Figures

FALSE TWISTING APPARATUS

BACKGROUND OF THE INVENTION

This invention relates to apparatus for carrying out false twisting of a yarn by clamping the yarn between opposing faces of two rotary discs.

Recently, there is a tendency of using DTY (Draw Textured Yarn) technique for performing simultaneously or continuously the drawing and the false twisting of the yarn to carry out the false twisting at high speeds. However, problems reside in the provision of a device capable of precisely carrying out the stable false twisting under high speeds and in the control of such a device to maintain operational stability during the false twisting process.

In order to remove such problems, until this time, the false twisting has been carried out by running the yarn while maintaining it in contact with either one of the outer peripheral surfaces of rotary discs or the inner or side surface of a cylinder, and the control for stable performance of the false twisting process has also been made by contacting discs which are rotated by a very small amount of torque to the running yarn under false twisting process and by detecting the number of twists of the yarn by calculation of the number of rotations of the discs. With such a false twisting method, the number of twists of the yarn is determined by the contact force of the yarn acting on the twisting surface of the rotary disc. Since this contact force depends on the tension of the yarn, considerably strong tension is required to obtain a large twisting force, and particularly, the untwisting side will require a tension larger than that on the twisting side, because on the untwisting side the yarn is drawn out. The application of the strong tension to the yarn makes it difficult to take up the yarn at high speed and this affects the quality of the twisted yarn.

To avoid the application of such strong tension to the yarn there has been proposed a method in which a yarn is inserted between the opposing end faces of two cup-shaped discs, and twisting and feeding forces are applied to the yarn by rotating the discs in the opposite directions. However, with false twisting apparatus of this prior type, an elastic material with high friction property, such as rubber, is applied to the yarn contacting surfaces of the rotary discs, which are adjusted and secured to a predetermined portion so as to provide a small gap between the facing yarn contacting surfaces of the discs or to cause the contact surfaces to contact each other with a suitable amount of contact pressure. Thus, the stable twisting force is applied to the yarn generally possessing a non-uniform diameter by putting the yarn between the contacting surfaces made of an elastic material.

However, even with this type of apparatus, because of the thermal expansion caused by the friction between the yarn and the elastic material on the discs and of the thermal expansion of the bearings utilized to support the rotary discs, it is difficult to clamp a fine yarn between the contacting surfaces of the opposing discs with a constant contact pressure, and in a case where liquid is required for cooling and lublicating the yarn contacting surface, the contacting portions, made of rubber, of the discs may become swollen by the liquid. For this reason, the gap between the contacting portions, which has been set by proper adjustment, may be narrowed or the contact pressure between the contacting portions may unnecessarily be increased. These defects have an effect on the quality of the twisted yarn, damage the contacting surfaces of the discs and in the worst case render the false twisting process impossible.

Furthermore, although the problem concerning the swelling of the contacting portions may be eliminated by using metal or material coated with ceramics or diamond as the contacting portions in place of the elastic material so as to keep a constant gap, such metal or material possesses no elasticity, so that it is difficult to clamp therebetween stably and firmly the yarn possessing a non-uniform diameter which varies depending upon the number of twists. It will also be impossible to remove adverse influences caused by the thermal expansion even if such metal or material is used.

SUMMARY OF THE INVENTION

Accordingly, a main object of this invention is to remove the abovementioned problems of the prior art and to provide apparatus for stably carrying out false twisting of a yarn over a long time while constantly maintaining the contact pressure between the contacting portions of the discs at the minimum required value, regardless of the material used to form the contacting portions.

Another object of this invention is to provide novel false twisting apparatus in which the gap between the yarn contacting surfaces of the discs is never reduced below a predetermined minimum gap, where the contact pressure between the yarn contacting surfaces is never increased over a predetermined value, thereby positively protecting the yarn and the yarn contacting surfaces.

A further object of this invention is to provide improved false twisting apparatus wherein the gap and the contact pressure between the contacting portions of the disc are kept to predetermined values during the false twisting process without suffering from adverse influences caused by thermal expansion, swelling or vibration of the apparatus.

According to this invention, there is provided apparatus for carrying out false twisting of a yarn of the type comprising a pair of opposing rotary discs between which the yarn is clamped to be false twisted and the improvement of the apparatus comprises means for supporting the rotary discs to be relatively movable towards and away from the each other and means for urging the rotary discs to contact them to each other with a predetermined gap.

BRIEF DESCRIPTION OF THE DRAWINGS

The other objects and advantages of this invention will be more fully understood from the following detailed descriptions of the preferred embodiments taken in conjunction with the accompanying drawings, in which.

DESCRIPTION OF THE PREFERRED EMBODIMENTS

In advance of the detailed description of the present invention, the movement of the yarn during false twisting operation will be described hereunder.

Figure 1:
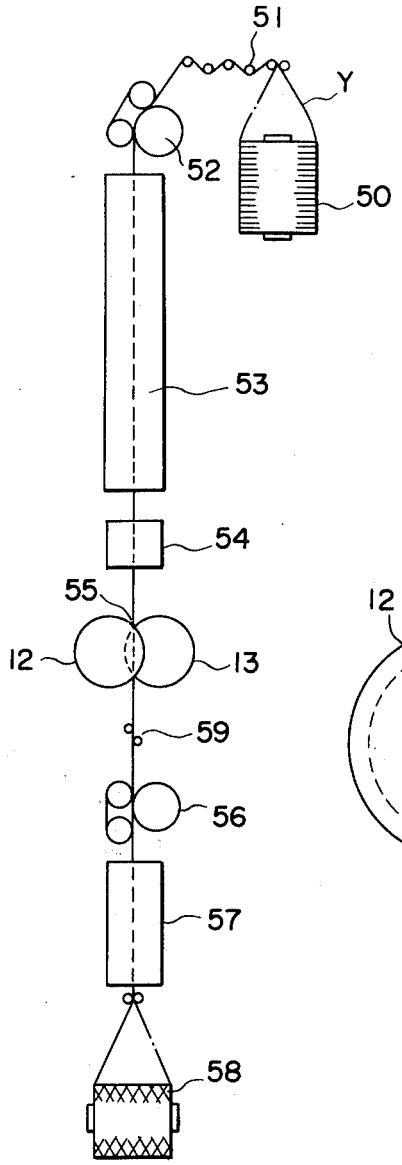
FIG. 1 is a diagrammatic view of a drawing type false twisting apparatus.
Figure 2:
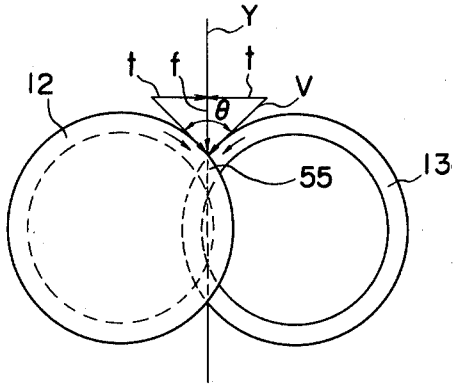
FIG. 2 is a view showing the tension applied to a yarn which is subjected to false twisting.

As shown in FIG. 1, a yarn Y is payed out from a supply bobbin 50 and guided to an intersecting portion 55 of rotary discs 12 and 13 for carrying out false twisting in a manner to be described hereinafter in detail, through a pretension device 51, a first feed roller 52, a heater 53 for fixing the twists of the yarn and cooling means 54. The yarn guided to the intersecting portion 55 passes through the center of the angle of the intersection of the discs 12 and 13 and runs in a direction at an acute angle with respect to the running direction at the intersecting portion. Therefore, as shown in FIG. 2, the false twisting of the yarn is performed under the condition that twisting force t and feeding force f are applied simultaneously to the running yarn.

After passing through the gap between the rotary discs 12 and 13 the yarn is taken up on a take-up drum 58 through a second feed roller 56 and a heater 57 for stabilizing crimp. Thus, the false twisting process has been accomplished. Further, a tention sensor 59 is provided on the way of the movement 8 of the yarn.

In the false twisting apparatus described above, if the second feed roller 56 is rotated at a speed faster than that of the first feed roller 52, the yarn is elongated between these rollers and is subjected to a DTY treatment, i.e., drawing false twisting treatment.

Figure 3:
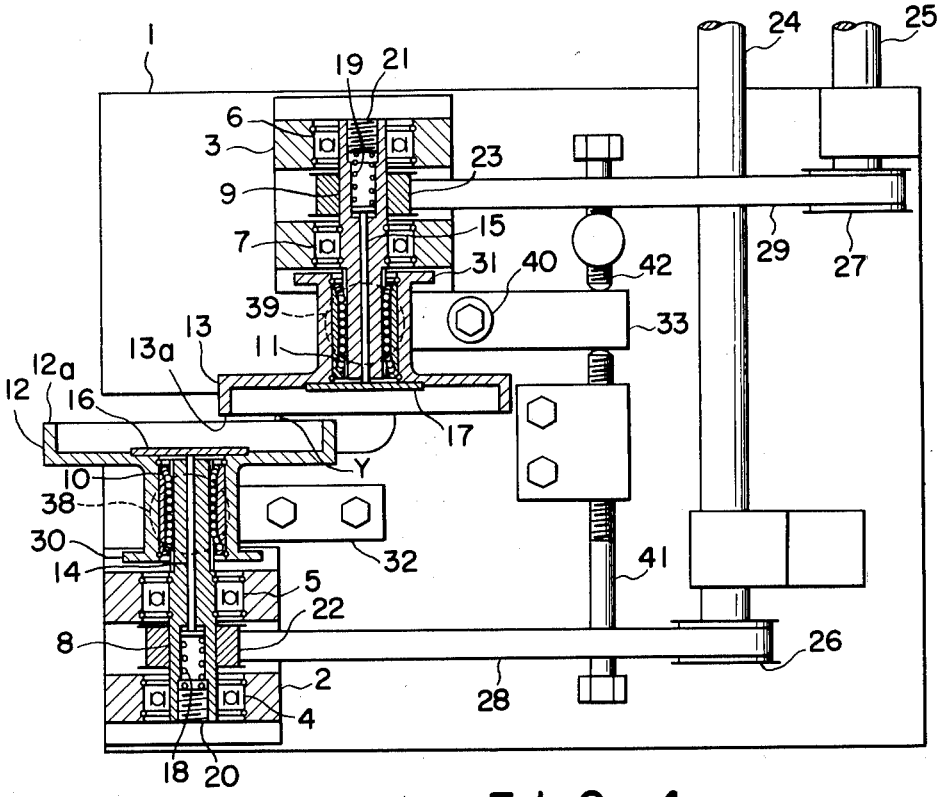
FIG. 3 is a plan view, partially in section, of one embodiment of false twisting apparatus according to this invention.
Figure 4:
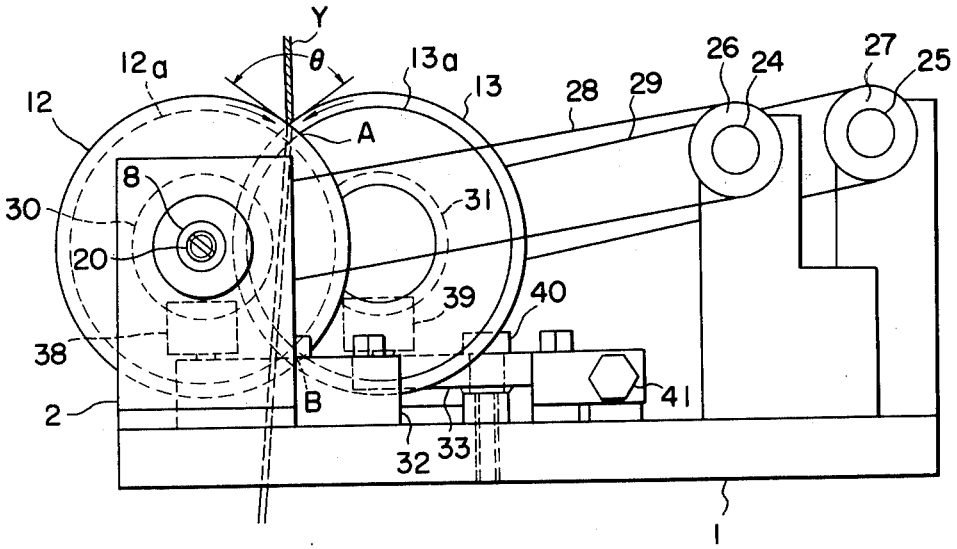
FIG. 4 is a front view of the apparatus shown in FIG. 3.
Figure 5:
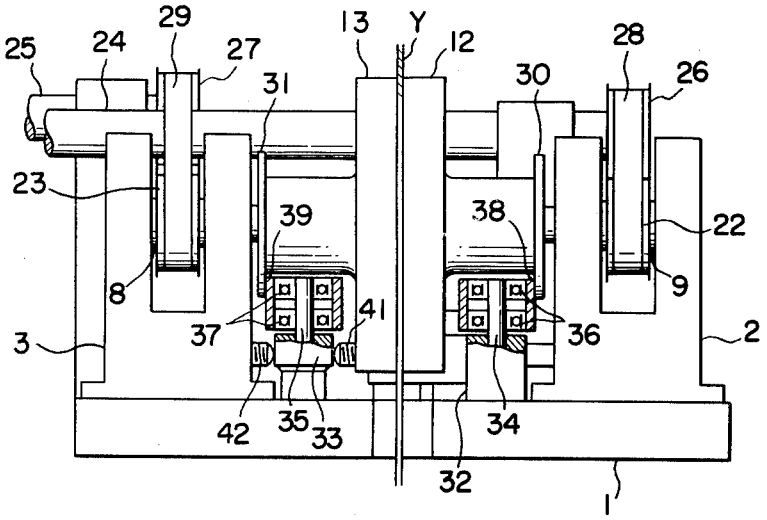
FIG. 5 is a side view, partially in section, of the apparatus viewed from left of FIG. 3.

Turning now to FIGS. 3, 4 and 5, showing a preferred embodiment of this invention, a flame 1 is provided with two brackets 2 and 3, to which shafts 8 and 9 are rotatably supported by means of bearings 4, 5 and 6, 7, respectively. The rotary discs 12 and 13 are mounted on the shafts 8 and 9 through slide balls 10 and 11 to be movable in the axial direction. The rotary discs 12 and 13 possess cup shaped front end portions with annular edges 12*a* and 13*a* (hereinbelow called yarn contacting portions) and are positioned so as to oppose each other. The axes of the discs are displaced such that they intersect at a suitable angle $\theta$ as clearly shown in FIG. 4.

In the axial openings of the shafts 8 and 9 are slidably contained push rods 14 and 15, the front ends of which abut against stiffening plates 16 and 17 secured to the rotary discs 12 and 13. Spring means 18 and 19 are fitted in the axial bores of the shafts 8 and 9 so that the rotary discs are resiliently pushed each other through the push rods 14 and 15. The spring force of this spring means is adjusted appropriately by adjusting screws 20 and 21. Timing pulleys 22 and 23 are mounted on the shafts 8 and 9 and driven by belts 28 and 29 which are driven by timing pulleys 26 and 27 secured to driving shafts 24 and 25, respectively. The pulleys 22 and 23 rotate discs 12 and 13 in the directions shown by the arrows in FIG. 4 at the same speed.

Flanges 30 and 31 are integrally provided for the rotary discs 12 and 13. Roller-type stop members 38 and 39 are rotatably mounted on pins 34 and 35 secured to a bracket 32 and an arm 33, respectively, through bearings 36 and 37 and are arranged to engage the flanges 30 and 31, thereby limiting the advanced positions of the rotary discs 12 and 13. The arm 33 is pivotally mounted on the frame 1 by means of a bolt 40 so that the position of the stop member 39 can be finely adjusted by means of adjusting screws 41 and 42.

The false twisting operation of the yarn according to this invention will be described hereunder.

Initially, the stop member 39 is adjusted by the adjusting screws 41 and 42 so that in the absence of a yarn, a gap smaller than the diameter of the yarn will be created between the contacting portions 12*a* and 13*a* of the rotary discs 12 and 13, and the contacting portions will contact the yarn passing therethrough under a contact pressure such that the contacting surfaces will not suffer from seizure.

The spring means 18 and 19 are also adjusted so that the yarn contacting surfaces 12*a* and 13*a* will be caused to contact the yarn by the adjusting screws 20 and 21 at a pressure necessary for the false twisting of the yarn.

With such arrangement of the stop member 39 and the spring means 18 and 19, the yarn Y is threaded to run between the contacting surfaces 12*a* and 13*a* through the upper intersecting point A but away from the lower intersecting point B as shown in FIG. 4. The rotary discs 12 and 13 are then moved rearward to separate them from each other against the force of the spfing means 18 and 19. The stop members 38 and 39 are then separated from the flanges 30 and 31 and the rotary discs are forced elastically by the spring means through the push rods 14 and 15 in a direction toward each other, thereby holding elastically the yarn Y between the contacting surfaces.

When the rotary discs 12 and 13 are rotated by the driving shafts 24 and 25, in the directions shown by the arrows in FIG. 4, through timing pulleys 26, 27 timing belts 28, 29, timing pulleys 22, 23, shafts 8, 9 and slide balls 10, 11, respectively, and when the yarn Y is passed from the upper side to the lower side as viewed in FIG. 4, the twisting force t and the feeding force f are then simultaneously imparted to the yarn in accordance with the angle $\theta$ of the intersection between the contacting surfaces of the rotary discs 12 and 13. Thus, the false twisting of the yarn is accomplished.

The twisting and feeding forces are related to the contact pressure caused by the spring means 18 and 19 between the yarn and the contacting portions and are determined by the frictional force therebetween. When the feeding force f varies, the untwisting tension, i.e. tension of the yarn between the rotary discs and the second feed roller 56 also varies. Therefore, by measuring this untwisting tension by the tension sensor 59, the twisting force t actually applied to the yarn Y and the number of twists related to this twisting force t are determined, and according to the value of the tension the gap between the discs and the number of twists of the running yarn can be adjusted by controlling the contact pressure.

Figure 9A:
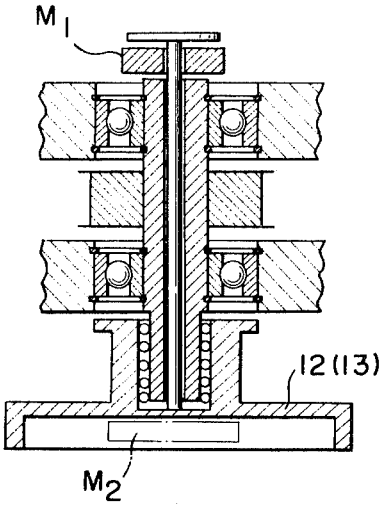
FIGS. 9(*a*), 9(*b*) and 9(*c*) are diagrammatic views showing further modified embodiments of this invention.
Figure 9B:
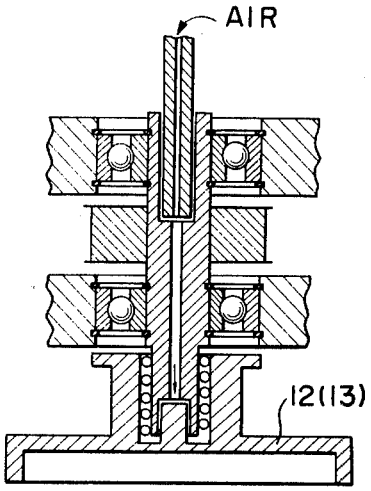
Figure 9C:
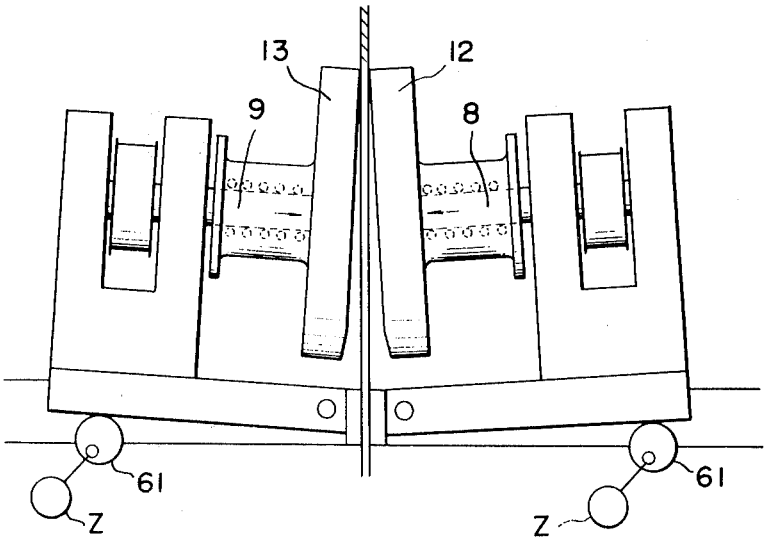

FIG. 9(*a*) through 9(*c*) diagrammatically show an other modified embodiments for adjusting the gap or the contact pressure. FIG. 9(*a*) shows a type in which an electromagnetic force is utilized for attracting the opposing discs and this attractive force is controlled by adjusting the current of electromagnets $M_1$ and $M_2$. FIG. 9(*b*) shows a type in which the rotary discs are adjusted by pneumatic pressure applied thereon, and FIG. 9(*c*) shows a type in which the force applied to the intersecting portion of the discs is adjusted by changing the inclination of the shafts 8 and 9 by using eccentric cams 61 operated by servo-motors Z.

In any one of the above cases, the automatic detection or adjustment of the number of twists of the yarn, which have been considered to be difficult in the past can be performed effectively by controlling the magnitude of the current flowing through the electromagnets and servo-motors in accordance with signals from the tension sensor or by controlling the pneumatic pressure by using an adjusting value. Thus, the control of the number of twists of the yarn can be easily performed.

During the false twisting operation even when thermal expansion of the shaft occurs, the contact pressure is maintained at a constant value which is determined only by the force of the spring means 18 and 19. This is due to the fact that the rotary discs 12 and 13 are slidably mounted on the shafts 8 and 9 by the slide balls 10 and 11. Accordingly, the gap between the yarn contacting portions 12*a* and 13*a* is always kept at a distance approximately equal to the diameter of the yarn to be twisted so that the contacting portions will not wear and the yarn will not be adversely influenced. Thus, extremely stable false twisting can be achieved for a long period of time.

Furthermore, in the cases where the rotary discs 12 and 13 are pushed forcebly towards each other or where the yarn Y is cut and lost between the contacting surfaces 12*a* and 13*a* by an accident, the advancing of the rotary discs is limited by the stop members 38 and 39 thereby protecting the yarn Y and the contacting surfaces. In these cases, since the gap and the contact pressure change from the original set value when the distances between the flanges 30 and 31 engaging with stop members and the yarn contacting surfaces 12*a* and 13*a* change during the operation of the apparatus, it is desirable to set the distances between the yarn contacting surfaces and the positions against which the stop members abut as small as possible.

Figure 6:
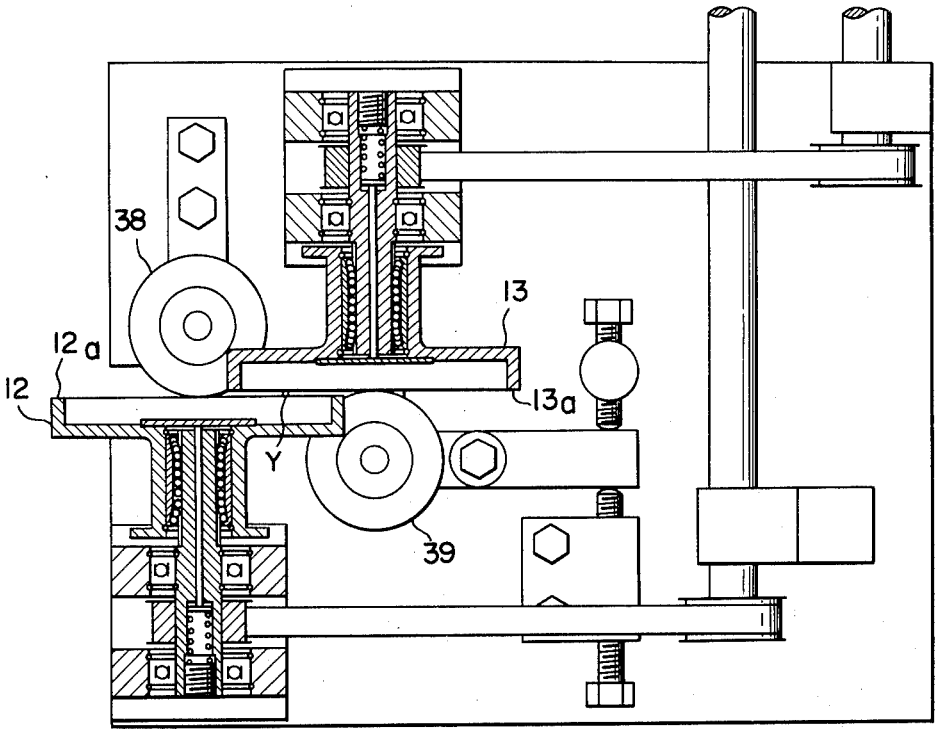
FIG. 6 is a plan view, partially in section, of another embodiment of this invention.
Figure 7:
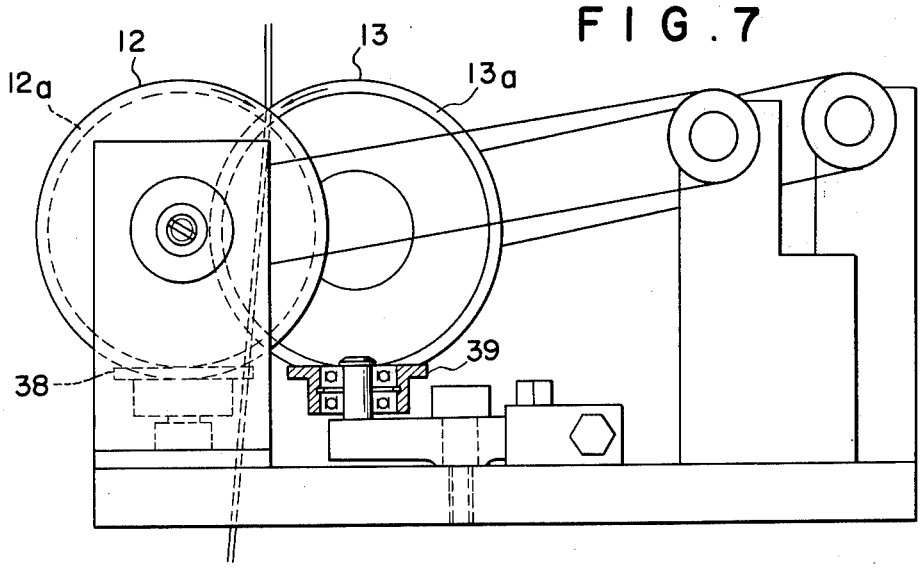
FIG. 7 is a front view, partially in section, of the apparatus shown in FIG. 6.

FIGS. 6 and 7 show a further embodiment of this invention, in which the stop members 38 and 39 directly abut against the respective contacting surfaces 12*a* and 13*a* of the rotary discs. In this embodiment, even when the contacting surfaces 12*a* and 13*a* are made of rubber having a tendency of swelling or other materials the dimensions of which greatly vary for some reason, it is possible to accurately control the gap between the contact surfaces and the contact pressure.

Figure 8:
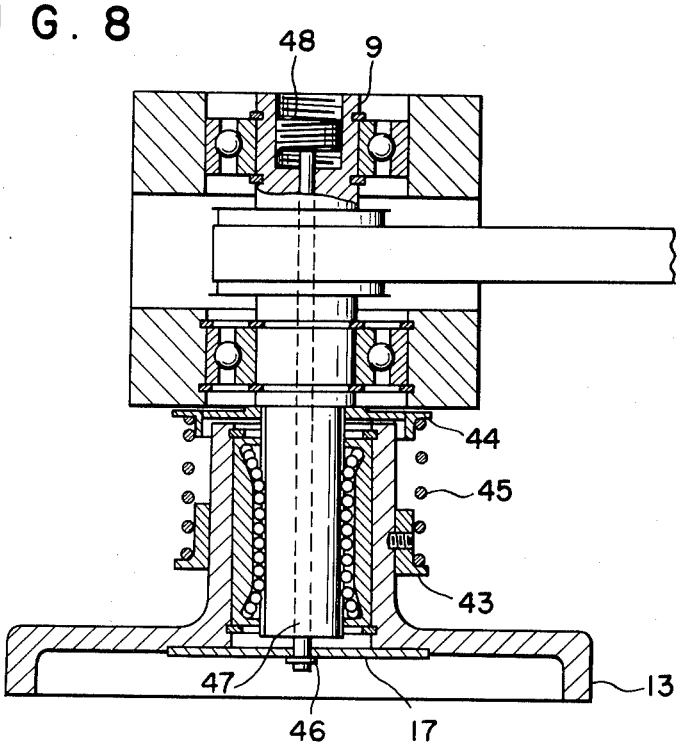
FIG. 8 is a longitudinal sectional view of a modified rotary disc.

In a still further modification shown in FIG. 8, spring means 45 is provided between spring supports 43 and 44 attached respectively to the boss of the rotary disc 13 and the shaft 9 so as to urge disc 13 toward the other disc. A stop member 46 is attached to the front end of a pin 47 slidably received in an axial opening or the shaft 9 and the stifening plate 17 so as to abut against it, thereby limiting the advancing position of the rotary disc 13 by the adjusting screw 48 attached to the other end of the pin 47.

In the foregoing disclosure during the normal operation, the stop members 38 and 39 do not operate and the yarn Y is clamped elastically between the yarn contacting surfaces by the spring means 18 and 19. However, it should be noted that the apparatus of this invention can also be used in the following manner.

The stop members 38 and 39 may be disposed at the position where there will be created a gap for clamping the yarn Y between the yarn contacting surfaces 12*a* and 13*a* with a constant pressure necessary for false twisting (in the case where an elastic material, such as rubber, is used as the yarn contacting portions of the discs, the gap could be substantially zero) and the spring means 18 and 19 possess relatively large force. In such a case, the yarn Y passing through the gap between the contacting surfaces can be positively subjected to the false twisting force while holding the rotary discs 12 and 13 at predetermined positions by the stop members 38 and 39.

The structure of the apparatus enables prevention of displacement of the discs caused by vibration of the apparantus and also enables the performance of the stable false twisting of the yarn while correcting the variation in dimensions due to thermal expansion or swelling of the contacting surfaces of the discs.

Although in the above mentioned embodiments, there is described a case where the opposing rotary discs are provided to be axially movable, when a yarn to be subjected to false twisting operation has relatively large diameter and where the volume variation of the yarn contacting surfaces 12*a* and 13*a* of the rotary discs 12 and 13 caused by thermal expansion is not so large, it will be possible, for example, to construct, the rotary disc 12 to be stationary and only the other disc 13 to be movable. Furthermore, means for movably supporting the discs can be replaced by other suitable means.

As is clear from the foregoing descriptions, according to this invention, the rotary discs which are required to be accurately possitioned can be precisely supported, and the rotary discs and the yarn are seldom affected by dimensional changes, such as, thermal expansion and swelling of the yarn contacting portions. Thus, the false twisting of the yarn can be accomplished extremely stably and accurately for a long period of time. Furthermore, in the case where a rotary disc which is provided with a yarn contacting portion, made of material other than elastic material, is used, the yarn can be clamped firmly by a predetermined contact pressure. Thus, the material of the yarn contacting portion of the rotary disc can be selected in accordance with the nature of the yarn to be false twisted.

It is to be understood by those skilled in the art that the foregoing description refers to some preferred embodiments of this invention and that various modifications and changes may be made without departing from the true scope and spirit of the invention as defined in the appended claims.

We claim:

1. In apparatus for carrying out false twisting of a yarn of the type comprising a pair of opposing rotary discs between which the yarn is clamped to be false twisted, the improvement which comprises means for supporting said rotary discs to be relatively movable towards and away from each other, and spring means for urging said rotary discs to face each other with a predetermined gap.

2. In an apparatus for carrying out false twisting of a yarn of the type comprising a pair of opposing rotary discs between which the yarn is clamped to be false twisted, the improvement which comprises means for supporting said rotary discs to be relatively movable towards and away from each other, and means for urging said rotary discs to face each other with a predetermined gap, said means for urging said rotary discs comprises the weight of the discs themselves.

3. The apparatus according to claim 1 or 2 which further comprises stop members for limiting the gap between the yarn contacting portions of said rotary discs, respectively.

4. The apparatus according to claim 3 wherein stop members means for limiting the gap is an electromagnet.

5. The apparatus according to claim 3 wherein said stop members for limiting the gap comprises means for applying pneumatic pressure to one of said discs.

6. The apparatus according to claim 3 wherein stop members means for limiting the gap is an eccentric cam actuated by a servo-motor for changing the inclination of said means for supporting the rotary discs.

* * * * *